United States Patent [19]

Hoyer et al.

[11] Patent Number: 4,506,425

[45] Date of Patent: Mar. 26, 1985

[54] METHOD FOR THE HOT REPAIR OF THE PROTECTIVE LAYER PROVIDED ON THE PERMANENT LINING OF A TUNDISH OF A CONTINUOUS CASTING PLANT

[75] Inventors: Otto Hoyer, Linz; Norbert Antensteiner, Leonding; Walter Fortner, Linz, all of Austria

[73] Assignee: Voest-Alpine Aktiengesellschaft, Linz, Austria

[21] Appl. No.: 283,203

[22] Filed: Jul. 14, 1981

[30] Foreign Application Priority Data

Jul. 16, 1980 [AT] Austria ..... 3685/80

[51] Int. Cl.[3] ..... B23P 7/00; B22D 11/126; B29C 17/02

[52] U.S. Cl. ..... 29/402.18; 266/281; 29/527.6; 29/527.3

[58] Field of Search ..... 29/402.18, 402.01–402.09, 29/402.11, 402.12, 402.14, 402.15, 402.17, 403.1, 403.3, 527.2, 527.3, 527.6; 164/483, 488, 437 US, 439; 266/281, 280

[56] References Cited

U.S. PATENT DOCUMENTS

| | | | |
|---|---|---|---|
| 1,868,699 | 7/1932 | Fulcher | 266/281 |
| 4,012,029 | 3/1977 | Seguin et al. | 266/275 |
| 4,064,925 | 12/1977 | Fastner et al. | 164/488 |
| 4,245,761 | 1/1981 | Hazlehurst et al. | 266/281 |

FOREIGN PATENT DOCUMENTS

| | | | |
|---|---|---|---|
| 269727 | 3/1969 | Austria . | |
| 254027 | 6/1975 | Austria . | |
| 829383 | 5/1975 | Belgium . | |
| 2169807 | 9/1973 | France . | |
| 39157 | 4/1981 | Japan | 164/488 |
| 1291355 | 10/1972 | United Kingdom . | |

*Primary Examiner*—Howard N. Goldberg
*Assistant Examiner*—V. K. Rising
*Attorney, Agent, or Firm*—Brumbaugh, Graves, Donohue & Raymond

[57] ABSTRACT

There is described a method for the hot repair of the protective layer provided on the permanent lining of a tundish of a continuous casting plant. The method can be carried out simply and quickly, with thermal losses of the tundish being largely prevented and heat influences on the personnel being eliminated, by retaining an amount of residual steel with a slag layer in the tundish. The residual-steel amount plus slag layer is cooled till solidification, is removed from the tundish in a still hot state, and a repair-mass constituting the protective layer is sprayed onto the permanent lining of the still hot tundish.

7 Claims, 1 Drawing Figure

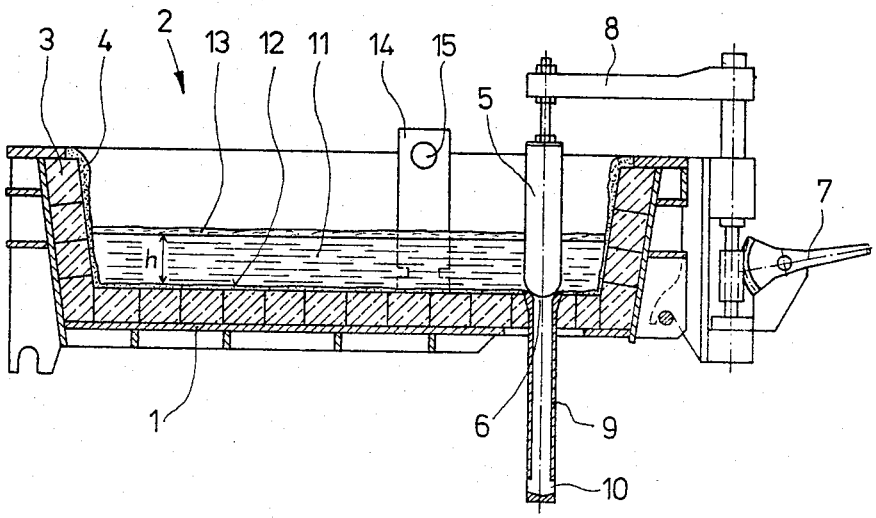
3
4
2
13
12
11
14
15
8
5
7
h
1
6
9
10

METHOD FOR THE HOT REPAIR OF THE PROTECTIVE LAYER PROVIDED ON THE PERMANENT LINING OF A TUNDISH OF A CONTINUOUS CASTING PLANT

BACKGROUND OF THE INVENTION

The invention relates to a method for the hot repair of the protective layer provided on the permanent lining of a tundish of a continuous casting plant.

It has proved advantageous for tundishes to provide the permanent lining with a wear resisting layer, a so-called working lining, which acts as a protective layer for the permanent lining. This working lining is renewed from time to time in order that the permanent lining below it will not be affected. So far, the renewal of the working lining has been carried out in the cold state of the tundish, i.e. by manually scooping out the tundish after having tilted out the molten metal and slag residues still present in the tundish immediately after the termination of casting, and subsequently applying the working lining. To this end it is necessary to cool the tundish over a longer period of time, by taking care that the temperature of the tundish does not sink to below a certain height in order to keep thermal losses low. Scooping out, therefore, due to the residual heat of the tundish, is an extremely exhausting and also long operation.

A further disadvantage of the known method of repair is the necessary long heating of the relatively cold tundish (in order to prevent an immediate solidification of the metal poured into the repaired tundish), with a certain temperature curve having to be observed. A rapid heating of the tundish is not possible, since the tundish would be damaged by the thermal stresses occurring.

It is known with tundishes (Austrian Pat. No. 335,647) to form the working lining by plates with a low thermal conductivity and a low thermal capacity. A granular material, e.g. quartz sand, is provided between the permanent lining and the working lining. Such plates have to be joined by refractory mortar, which requires much work.

It is furthermore known to provide the plates of the working lining with tongue-and-groove connections, thus rendering the placing simpler; yet, such plates are complex in their production.

SUMMARY OF THE INVENTION

The invention aims at avoiding these disadvantages and difficulties and has as its object to provide a method for the hot repair of the protective layer on the permanent lining of a tundish of a continuous casting plant, which can be carried out simply and quickly, by which thermal losses of the tundish are largely prevented and which furthermore guarantees that the repair crew may perform the necessary work without impediment, despite the high thermal contents of the tundish to be repaired.

This object is achieved according to the invention in that an amount of residual steel with a slag layer on top of it is retained in the tundish. This residual-steel amount with the slag layer covers the bottom of the tundish and is cooled until it solidifies. The residual-steel amount with the slag layer, which has solidified into a plate, subsequently is removed from the tundish in a still hot state, whereupon a hot-repair mass constituting the protective layer is sprayed onto the permanent lining of the still hot tundish.

This method entails a substantial saving of time. Immediately after the solidification of the residual-steel amount with the slag layer these layers may be removed, for instance by tilting the tundish, the old protective layer of the tundish adhering to the solidified residual-steel amount and being removed together therewith. One need not wait until the tundish has cooled down completely, but may apply the new protective layer on the still hot permanent lining, which preferably has a temperature of between 500° C. and 1,300° C. The drying time for the newly applied protective layer is extremely short, since the drying is strongly accelerated by the hot permanent lining lying immediately below the working lining. Thereby also an enrichment of hydrogen and a formation of pores in the strand is prevented at the onset of casting. Furthermore, the heating of the tundish, which takes hours, is saved with a tundish repaired in this manner. The casting personnel is no longer subjected to the noise and heat involved in the heating.

Advantageously, the residual-steel amount and slag layer solidified into a plate are removed from the tundish in a still glowing state, the cooling of the residual-steel amount being effected in a manner that the temperature of the permanent lining of the tundish is between 500° C. and 1,300° C.

In order to save the stopper, suitably the casting tube is sealed and the stopper is removed prior to the solidification of the residual-steel amount retained in the tundish.

For an easier removal of the solidified residual-steel amount at least one holding means, preferably a steel plate strip with an eyelet, is immersed into the residual-steel amount prior to its solidification, which holding means welds with the residual-steel amount and projects out of the same.

BRIEF DESCRIPTION OF THE INVENTION

The invention will now be explained in more detail with reference to the accompanying single FIGURE of the drawing illustrating a tundish in section.

DETAILED DESCRIPTION OF THE INVENTION

A tundish 2 outwardly surrounded by a steel plate jacket 1 inwardly is lined with a permanent lining 3. As a protective layer for the permanent lining a working lining 4 is applied on the permanent lining, having a thickness of 20 to 30 mm when new. This working lining, in the embodiment illustrated, is constituted by sprayed-on sintered magnesite having the following chemical composition:

about 63% MgO
about 13% $Cr_2O_3$
about 8% $Fe_2O_3$
about 6% $Al_2O_3$
about 2% CaO
about 8% $SiO_2$ A stopper 5 for closing the outflow opening 6 and for controlling the steel amount flowing out is liftable and lowerable by means of a hand lever 7 moving the holding arm 8 of the stopper 5. A casting tube 9 is inserted into the outflow opening 6, which is designed as an immersion tube having lateral outlets 10 and immersing into the mould.

In case the working lining 4 has but a slight thickness only (as illustrated in the drawing) and thus has to be renewed, a residual-steel amount 11 covering the bottom 12 and having a height h of about 100 to 200 mm, preferably a height of about 150 mm, and the slag layer 13 present on the same are retained in the tundish 2. The stopper 5 is closed when this residual-steel amount 11 is in the tundish, whereupon the tundish 2 is lifted from the casting platform and placed on the mill floor. There the casting tube 9 is knocked off and the outflow opening 6 is closed (obstructed) from below. Subsequently, the stopper 5 is lifted and pivoted aside or removed by tilting the stopper holding means; thus, the stopper is re-usable. After this procedure the residual-steel amount 11 in the tundish is cooled until the temperature of the permanent lining 3 is between 500° C. and 1,300° C. However, before the residual-steel amount 11 solidifies, a lug-shaped steel plate strip 14 is immersed therein, which welds with the residual-steel amount 11. This steel plate strip 14 serves for being capable of removing the residual-steel amount 11 solidified into a plate more easily from the tundish by loosening the solidified residual-steel amount, for instance, by means of a crane hook hung into the eyelet 15 of the steel plate strip.

After loosening the residual-steel amount 11 solidified into a plate plus the slag layer 13 (also solidified), it is removed in a still glowing state, e.g. by tilting the tundish.

The old working lining 4, which adheres to the residual-steel amount 11 solidified into a plate is removed together therewith, the tundish being ready for the application of a new working lining.

The application of the new working lining is effected by spraying on a hot-repair mass, e.g. by spraying on sintered magnesite having the above-defined chemical composition.

The drying of the new working lining is effected by the permanent lining 3 of the tundish still having a temperature of between 500° C. and 1,300° C. In order to make sure that the new working lining has dried completely, it may be briefly afterdried before re-using the tundish.

In order to avoid thermal stresses in the stopper and in the casting tube, it is merely necessary, prior to the onset of casting, to heat up the stopper and the casting tube. No cover is required for the tundish itself.

What we claim is:

1. A method for the hot repair of a sprayed on protective layer provided on the permanent lining of a tundish of a continuous casting plant, which method comprises the steps of retaining a residual amount of steel having a layer of slag thereon in said tundish, said slag-covered steel covering the bottom of said tundish, cooling said residual-steel and slag layer until it solidifies into a plate adhering to said protective layer, removing said plate from said tundish in a still hot state along with said adhering protective layer, and spraying a hot-repair mass onto the permanent lining of the still hot tundish so as to form a new protective layer.

2. A method as set forth in claim 1, wherein said residual-steel amount plus slag layer solidified into a plate is removed from said tundish in a still glowing state.

3. A method as set forth in claim 1, wherein the cooling of said residual-steel amount is effected in a manner that the temperature of said permanent lining of said tundish lies between 500° C. and 1,300° C.

4. A method as set forth in claim 1 to be carried out with a tundish having a casting tube and a stopper, wherein, prior to the solidification of said residual-steel amount retained in the tundish, said casting tube is sealed and said stopper is removed.

5. A method as set forth in claim 1, wherein, prior to the solidification of said residual-steel amount, at least one holding means is immersed into said residual-steel amount, said at least one holding means welding with said residual-steel amount and projecting therefrom.

6. A method as set forth in claim 5, wherein said at least one holding means is comprised of a steel plate strip having an eyelet.

7. A method as set forth in claim 1, wherein the removal of said residual-steel amount plus slag layer solidified into a plate is effected by tilting said tundish.

* * * * *